US006125473A

United States Patent [19]

Hochmuth

[11] Patent Number: 6,125,473

[45] Date of Patent: Oct. 3, 2000

[54] THUMB SECTION FOR A GOALKEEPER'S GLOVE

[76] Inventor: Peter Hochmuth, Weissenburger Strasse 19, D-91757 Treuchtlingen, Germany

[21] Appl. No.: 09/387,912

[22] Filed: Sep. 1, 1999

[30] Foreign Application Priority Data

Oct. 19, 1998 [DE] Germany ..... 298 18 597

[51] Int. Cl.[7] ..... A41D 19/00

[52] U.S. Cl. ..... 2/161.1; 2/16; 2/164

[58] Field of Search ..... 2/16, 20, 159, 2/161.1, 161.2, 161.3, 161.6, 163, 164, 167, 169

[56] References Cited

U.S. PATENT DOCUMENTS 5,937,444 8/1999 Hochmuth ..... 2/161.1

FOREIGN PATENT DOCUMENTS 2035717 2/1991 Canada ..... 2/16
3135-756 4/1983 Germany ..... 2/161.1
2237974 5/1991 United Kingdom ..... 2/16

*Primary Examiner*—John J. Calvert
*Assistant Examiner*—Katherine Moran
*Attorney, Agent, or Firm*—Brown & Wood, LLP

[57] ABSTRACT

A thumb section for a goalkeeper's glove including inner and upper thumb portions connected along ball-side, gusset-side and tip regions by a seam forming a seam join, a latex layer provided on an outer side of the inner hand thumb portion of the seam, and a latex accessory layer enveloping a ball-side portion of the seam join and formed as a continuation of the latex layer, with the latex accessory layer lying on the upper hand thumb portion and being connected thereto by a separate seam.

6 Claims, 2 Drawing Sheets

THUMB SECTION FOR A GOALKEEPER'S GLOVE

BACKGROUND OF THE INVENTION

1. Field of the Invention

The present invention relates to a thumb section for a goalkeeper's glove including an inner hand thumb portion, an upper hand thumb portion connected with the inner hand thumb portion along ball-side, gusset-side and tip regions by a seam forming a seam join, and a latex layer provided on an outer side of the inner hand thumb portion and secured thereto along the ball-side and tip regions by a portion of the seam.

2. Description of the Prior Art

In the conventional goalkeeper's gloves having a thumb section formed as discussed above, both the inner hand thumb portion and the upper hand thumb portion include each a corresponding cloth support layer, and both support layers and the latex layer lie flat during stitching. Thus, the seam join is formed of three, placed over each other layers. This seam join does not affect functioning of the glove in the gusset-side elongate region of the thumb because this gusset side elongate region hardly contacts the divertable ball and is covered when the glove-wearing hand is clenched into a fist. However, in a conventional glove, a portion of the seam join in the ball-side elongate region can affect functioning of the glove during repulsion of a ball. When the seam join or a portion of the cloth support layer facing a ball, which forms the upper hand thumb portion, touches the ball, the seam join or the corresponding portion of the cloth support layer slides over the ball, and the glove does not perform its function of handling the ball properly, which results in imprecise repulsion of the ball.

Accordingly, an object of the present invention is to provide a thumb section for a goalkeeper's glove, with which the ball-side elongate region of the thumb seam join and the upper hand thumb portion are modified with relatively simple means that would insure an improved handling of a ball.

SUMMARY OF THE INVENTION

This and other objects of the present invention, which will become apparent hereinafter are achieved by providing a latex accessory layer enveloping a ball-side portion of the seam join and formed as a continuation of the latex layer, with the latex accessory layer lying on the upper hand thumb portion and being connected thereto by a separate seam.

The ball-side seam join of the thumb is an essential part of the upper hand thumb portion. It is covered, according to the invention, with the latex accessory layer which provides for better contact with the ball, insuring its repulsion. It is very simple to cut-out the latex layer of the inner hand thumb portion, together with latex accessory layer, as a single sheet, with the latex accessory layer being stitched to the upper hand thumb portion. The latex accessory layer covers the seam join formed in a ball-side elongate region as well as the surface region adjoining the ball-side elongate region. The rounding of the latex accessory layer region, which surrounds the ball-side seam 3 oln, provides for better contact of the glove with the ball. It is also improves repulsion of a ball with a fist. Enveloping of the seam join formed in the ball-side elongate region is important. As a rule, the enveloping portion of the latex accessory layer extends along the entire length of the seam join of the ball-side elongate region.

It is particularly preferable and advantageous when at least one fourth of the width of the upper hand thumb portion is covered by the latex accessory layer. It envelopes the seam join to a degree which is adequate to achieve a desired action along a sufficient portion of the ball circumference.

As a rule, at least one third of the width of the upper hand thumb portion is enveloped by the latex accessory layer.

It is further particularly advantageous and preferable when the latex accessory layer, which is provided on the upper hand thumb portion, extends up to the tip region and is there secured to the thumb-portion by a seam. this improves retaining the latex accessory layer on the upper hand thumb portion.

It is further preferable and advantageous when the seam, with which the latex accessory layer is stitched to the tip region, extends along the entire tip region. This further improves the abutment of the latex accessory layer to the upper thumb region. It also facilitates the stitching of the entire latex accessory layer to the all of the respective components of the glove thumb.

According to the invention, a predetermined sequence of a seam formation is needed. According to the invention, a seam portion, which forms the ball-side portion of the seam join, defines a first seam, the separate seam, which extends along a free edge of the latex accessory layer, defines a second seam, and the seam portion, which extends along the gusset-side elongate region and the tip region defines a third seam. Without the foregoing seam sequence, the latex accessory layer, which is provided according to the invention, could not be economically realized.

According to a particularly preferable and advantageous embodiment of the present invention, the latex accessory layer is formed as one piece with an entire inner hand latex layer which includes, in addition to the latex layer, which is provided on the inner hand thumb portion, a palm layer for covering a palm portion of a goalkeeper's glove, and four front finger regions covering four inner finger regions of the goalkeeper's glove. This inner hand latex layer can be cut in a single cut. It is stitched not only to the other part of the inner hand but also to the upper hand thumb portion.

BRIEF DESCRIPTION OF THE DRAWINGS

The objects and advantages of the present invention will be come more apparent and the invention itself will be best understood from the following detailed description of the Preferred Embodiment, when read with reference to the accompanying drawings, wherein.

DETAILED DESCRIPTION OF THE PREFERRED EMBODIMENT

Figure 1:
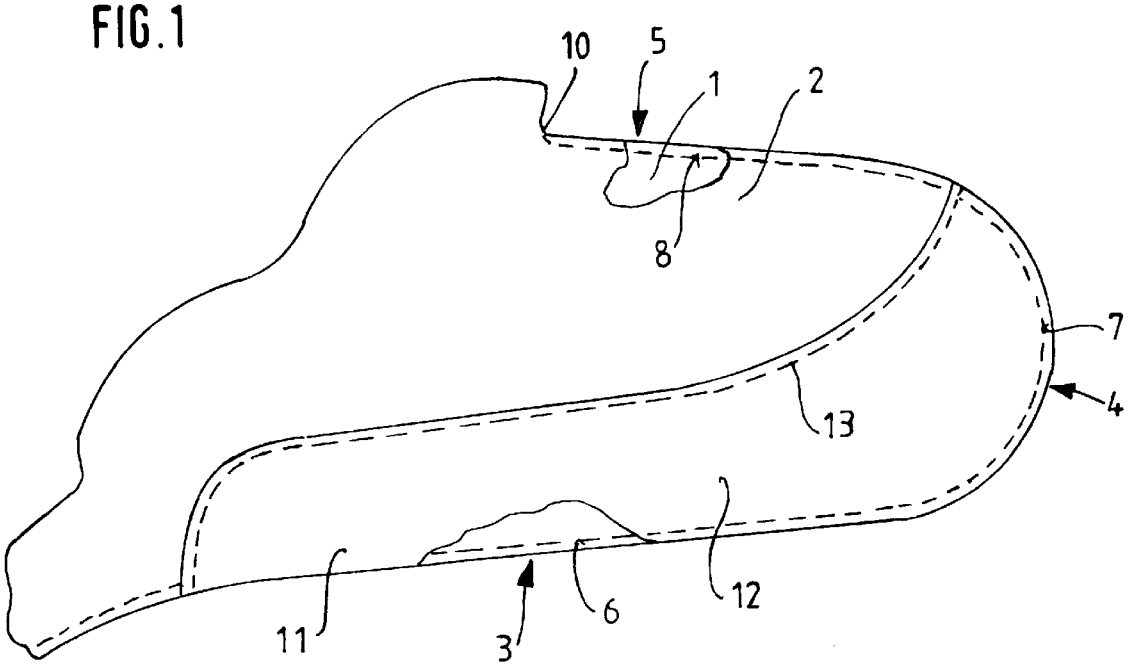
FIG. 1 shows a plan view of a thumb section of a goalkeeper's glove according to the present invention.
Figure 2:
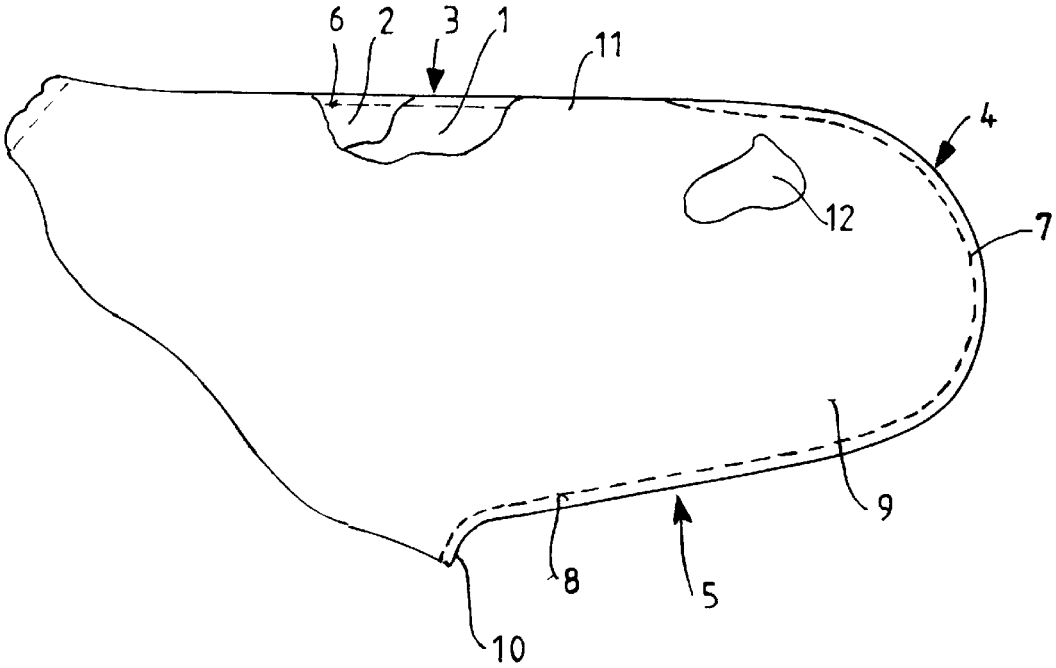
FIG. 2 shows a bottom view of the thumb section shown in FIG. 1.

A goalkeeper's glove according to the present invention, which is shown in the drawings, includes an inner hand portion (not shown in detail), an inner hand thumb portion 1 formed of a cloth support layer, and an upper hand thumb portion 2 likewise formed of a cloth support layer. The upper hand thumb portion 2 passes into an intermediate portion, not shown in detail. The inner and upper thumb portions 1 and 2 are placed one upon the other and are connected with each other along a ball-side region 3, a tip region 4, and a gusset-side elongate region 5 with seams 6, 7, 8, respectively.

The inner hand thumb portion 1 is covered with a latex layer 9 which is secured to the tip region 4 with the seam 7 and to the gusset-side elongate region 5 with the seam 8. The gusset-side elongate region 5 forms, together with an index finger, not shown in detail, a gusset 10. At the ball-side or outer elongate region 3, the latex layer 9 of the inner hand thumb portion 1 passes, in the bent-around portion 11, into a latex accessory layer 12 which is placed onto the upper hand thumb portion 2. Along the free edge of the latex accessory layer 12, there is provided a seam 13 which connects the latex insert layer 12 with the upper hand thumb portion 2.

Figure 3:
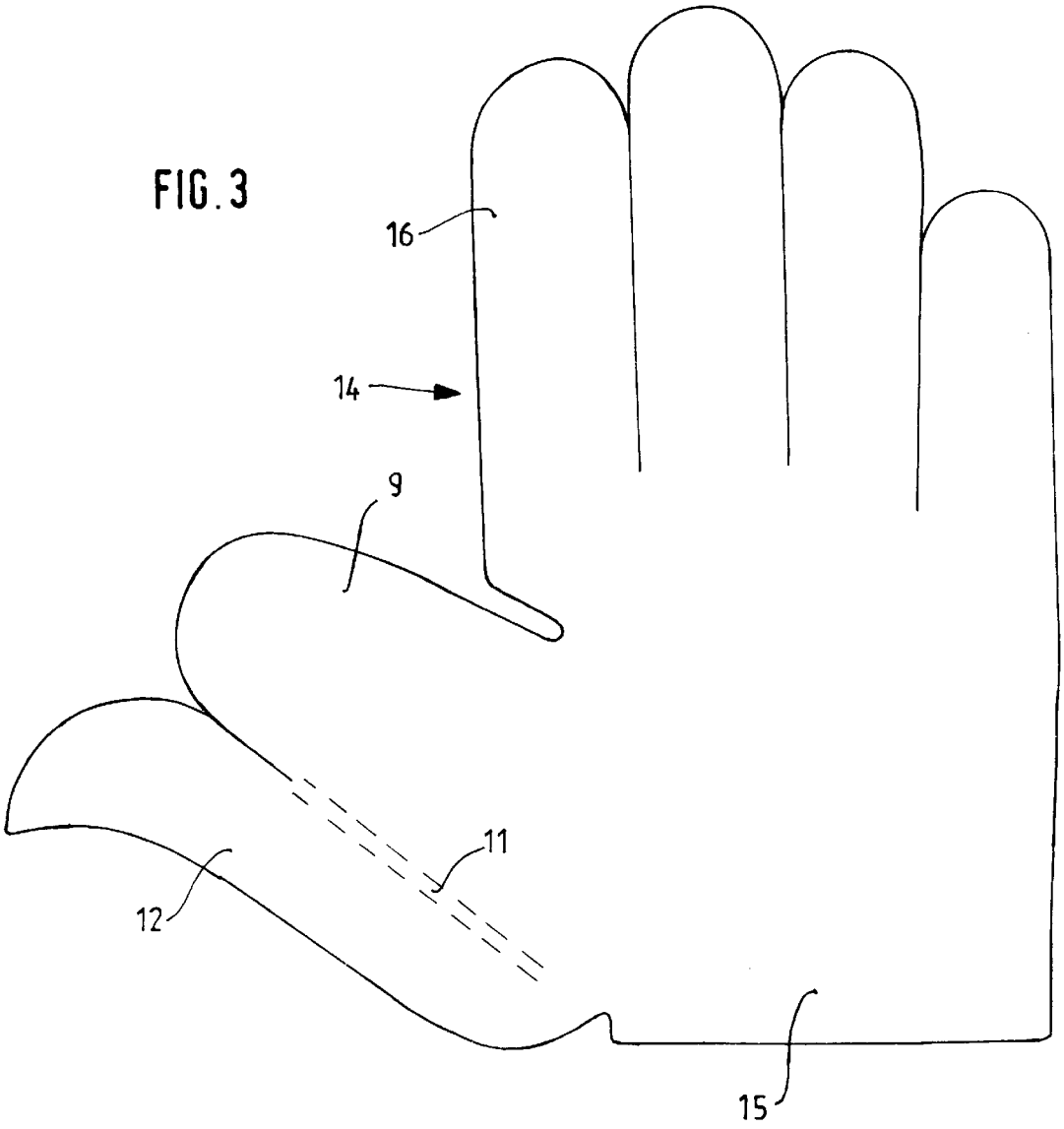
FIG. 3 shows a plan view of a latex inner hand layer of the goalkeeper's glove shown in FIG. 1 in a flattened condition.

FIG. 3 shows an entire inner hand latex layer 14 which has a palm region 15, four finger regions 16 and includes the latex layer 9 of the inner hand thumb portion 1. The latex accessory layer 12 is formed as a continuation of the latex layer 9 of the inner hand thumb portion 1.

Though the present invention has been shown and described with reference to a preferred embodiment, such is merely illustrative of the present invention and is not to be construed as a limitation thereof, and the present invention includes all modifications, variations and/or alternate embodiments within the spirit and scope of the present invention as defined by the appended claims.

What is claimed is:

1. A thumb section for a goalkeeper's glove, comprising:

an inner hand thumb portion;

an upper hand thumb portion connected with the inner hand thumb portion along ball-side, gusset-side and tip regions by a seam forming a seam join;

a latex layer provided on an outer side of the inner hand thumb portion and secured thereto along the ball-side and tip regions by a portion of the seam; and a latex accessory layer enveloping a ball-side portion of the seam join and formed as a continuation of the latex layer, the latex accessory layer lying on the upper hand thumb portion and being connected thereto by a separate seam.

2. A thumb section as set forth in claim 1, wherein at least one fourth of a width of the upper hand thumb region is covered by the latex accessory layer.

3. A thumb section as set forth in claim 1, wherein the latex accessory layer extends on the upper hand thumb portion up to the tip region and is connected to the upper hand thumb portion in the tip region by a tip portion of the seam.

4. A thumb section as set forth in claim 3, wherein the tip portion of the seam, which connects the latex accessory layer with the upper hand thumb region in the tip region, extends along an entire tip region.

5. A thumb section as set forth in claim 1, wherein a seam portion, which forms the ball-side portion of the seam join, defines a first seam, wherein the separate seam, which extends along a free edge of the latex accessory layer, defines a second seam, and wherein seam portion, which extends along the gusset-side elongate region and the tip region, defines a third seam.

6. A thumb section as set forth in claim 1, wherein the latex accessory layer is formed as one piece with an entire inner hand latex layer which includes, in addition to the latex layer, which is provided on the inner hand thumb portion, a palm layer for covering a palm portion of a goalkeeper's glove, and four front finger regions for covering four inner finger regions of the goalkeeper's glove.

* * * * *